US006102607A

United States Patent [19]

Kintscher

[11] Patent Number: 6,102,607

[45] Date of Patent: Aug. 15, 2000

[54] DEVICE FOR CONNECTING CONCRETE COMPONENTS

[75] Inventor: Matthias Richard Kintscher, Memmingen, Germany

[73] Assignee: Pfeifer Holding GmbH & Co. KG, Memmingen, Germany

[21] Appl. No.: 09/147,559

[22] PCT Filed: Jul. 18, 1997

[86] PCT No.: PCT/EP97/03870

§ 371 Date: Jan. 20, 1999

§ 102(e) Date: Jan. 20, 1999

[87] PCT Pub. No.: WO98/03751

PCT Pub. Date: Jan. 29, 1998

[30] Foreign Application Priority Data

Jul. 20, 1996 [DE] Germany ..... 296 12 573

[51] Int. Cl.[7] ..... E04B 1/41; E04G 21/12

[52] U.S. Cl. ..... 403/291; 403/269; 52/185.2; 52/125.5; 52/707; 52/587.1; 294/89

[58] Field of Search ..... 403/12, 33, 291, 403/269; 52/125.2, 125.3, 125.4, 125.5, 125.6, 707, 587.1; 294/89, 82.1, 1.1

[56] References Cited

U.S. PATENT DOCUMENTS

| | | | |
|---|---|---|---|
| 1,285,202 | 11/1918 | Hurley | 52/707 |
| 2,527,063 | 10/1950 | Heuer | 52/125.5 |
| 3,124,385 | 3/1964 | Neptune | 52/125.5 |
| 4,262,951 | 4/1981 | Hoyer | 294/89 |
| 4,821,994 | 4/1989 | Fricker | 52/125.5 |
| 5,548,937 | 8/1996 | Shimonnhara | 52/125.5 |
| 5,649,782 | 7/1997 | Frohlich et al. | 52/125.5 |
| 5,729,951 | 3/1998 | Frohlich | 52/707 |

FOREIGN PATENT DOCUMENTS

| | | |
|---|---|---|
| 0024697 | 3/1981 | European Pat. Off. . |
| 0534475 | 3/1993 | European Pat. Off. . |
| 1684254 | 5/1971 | Germany . |
| 3322646 | 3/1984 | Germany . |
| 666931 | 8/1988 | Switzerland . |
| WO96/31671 | 10/1996 | WIPO . |

*Primary Examiner*—Anthony Knight
*Assistant Examiner*—Ken Thompson
*Attorney, Agent, or Firm*—Jacobson, Price, Holman & Stern, PLLC

[57] ABSTRACT

A device for assembling prefabricated concrete parts has a cable loop anchored at one end to the prefabricated concrete part. The other loop-like end cooperates with a retaining means provided at the front face of the prefabricated concrete part to elastically bend the cable loop approximately at right angle during the fabrication of the prefabricated concrete part, and to release it for assembling. An elongated, U-shaped box (1) having a substantially uniform cross-section is provided as retaining means. The bottom (2) of the box has one or several passages (4) for the cable loop (5) and means arranged in the area of the passages (4) to retain the cable loop (5) perpendicularly to the longitudinal extension of the box (1).

22 Claims, 3 Drawing Sheets

DEVICE FOR CONNECTING CONCRETE COMPONENTS

SUMMARY

Figure 2:
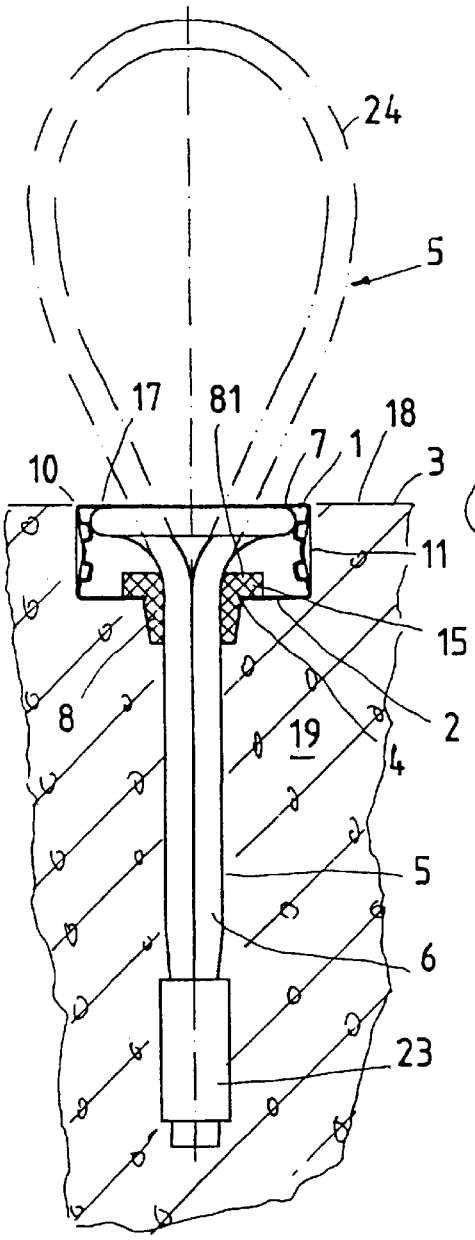

This invention relates to a device for connecting concrete components, consisting at least one rope loop, one end of which is anchored in the concrete component. The other end is looped and acts in conjunction with a fixing device set into the face of the concrete component, in order to flexibly bend the rope loop during the manufacture of the concrete component approximately into a right angle and to disengage it for the connection. An elongated U-shaped box with substantially uniform cross section is proposed as holding means, the floor of the box providing one or more openings for the rope loop together with means near the opening for holding the rope loop at a right angle relative to the longitudinal plane of the box.

This invention relates to a device for connecting concrete components, consisting of at least one rope loop, one end of which is anchored in the concrete component and the other looped end acts in conjunction with a fixing device set into the face of the concrete component, in order to flexibly bend the rope loop during the manufacture of the concrete component approximately into a right angle and to release it for making the connection.

A device according to the above type was disclosed in DE-OS 16 84 254. In this device, the rope loop or similar is bent by a fixing device in such a way that one part of the rope loop is anchored in the concrete component. The other part is fixed to the fixing device and can be raised to produce the operative position. Fixing of the rope loop in the fixing device is achieved by a nose-shaped component in the central plane of the fixing device. Similar devices are described in EP 0 534 475-A1 and DE 4 131 956-A1.

Apparatus of the type in question aim to create an arrangement in which, during manufacture of the concrete component and during its handling, the rope loop or similar element does not protrude beyond the external dimensions of the concrete component, in order to prevent the rope loop or similar becoming a nuisance during handling or stacking. However, after the concrete components have been displaced it should be possible to interlock the adjacent concrete components at their respective surfaces. This is made possible by the loose rope loop, which is subsequently covered by concrete cast over the top of the assemblies.

EP-OS 0 534 475 describes a different device for the purpose discussed. This provides a fixing block in the insert part, which fixes the rope loop without mechanical stress being exerted on the insert part, so that the fixing may be flexibly deformed and fixed largely at right angles.

This invention aims to further develop a device of the type first described above, so that is may be easily and cost effectively manufactured, avoiding interference during the manufacturing process and whereby the rope loop may be easily brought into the connecting position.

To solve this task, this invention takes a device of the type first described above and proposes that the fixing device is designed as an elongated U-shaped box of approximately uniform cross section, whereby the substantially flat box floor, which extends parallel to the face of the concrete component, is provided with an opening for the rope loop together with holding means near the opening, which hold the part of the rope loop which is to be anchored substantially at a right angle to the longitudinal plane of the box; and longitudinal retaining elements running in the edge regions of the limbs of the U, which hold the bent-over rope loop in the box, yet which enable the rope loop to be freed from the holding position.

This invention, through a simple component, i.e. the essentially U-shaped box, achieves an arrangement which may be easily incorporated into the shuttering used for the manufacture of concrete components. The dimensions, in particular perpendicular to the face of the concrete component, are small, so that generally collisions with other reinforcements are avoided. The box is sufficiently stable to withstand the bending forces. No special tools are required for freeing the loops.

The opening, which this invention provides in the box floor, is generally limited on all sides by the box floor. However, this opening may also be provided in the edge region so that it is open to one side of the box.

It is preferred that the opening provides a flange, acting on the part of the rope loop which is to be anchored. One example would be a fold bent out of the opening against the concrete component, which would form a support for the part of the rope loop which is to be anchored.

In one preferred embodiment of the invention a seal is provided to close the gap between the rope loop and the opening. Such design ensures that no concrete enters the box during filling the prepared shuttering mould, which would render the box or the loop unusable.

A preferred embodiment of this invention provides various options for such seals. One example for such a means of sealing would be a formed plastic part, which is held by the box, as will be described further. However, it is also possible to arrange adhesive between the rope loop, which is pushed through the opening, and the box; for example a drop of adhesive, resin or similar. This would, firstly, provide a means of mechanically fixing the rope loop relative to the box and, secondly, would seal the gap, so that ingress of concrete is prevented. Similarly it is possible to use a foam filler. The means of sealing are for example also selected so that they will neither be subjected to bending stresses, e.g. they will not be subjected to bending forces, nor that they should support the bending effect when the rope loop is bent and in particular when the rope loop is laid into the box. This may be achieved, for example, by respective arrangement of the formed part inside or on the holding box. Use of adhesive or foam filler only serves to seal off the remaining gap and does not fulfill any other support function with regard to possible bending, stresses.

Particularly favourable conditions are achieved, when a shaped plastic part is inserted into the opening, which acts upon the part of the rope loop which is to be anchored. In conjunction with the box this formed part can easily play a number of different roles. Firstly it assists in shaping the rope loop, whereby it acts in conjunction with retaining elements in the edge region of the limbs of the U. However, it also guides the part of the rope loop which is to be embedded into concrete, so that it is placed into its correct position.

Preferably the formed part is designed so that is closes the gap between the rope loop and the opening. The formed part thereby prevents ingress of concrete into the inside of the box, which would prevent the rope loop from later being put into an upright position.

The formed part may be designed in different ways. For example, it may provide a flange which would abut the box floor. This and other designs envisage that the formed part and the opening deviate from rotational symmetry in order to fix the inserted formed part in the opening by rotational movement. The formed part may be easily inserted if, for example, both it and the opening are designed as ovals. Particularly the use of flanges or similar means would ensure secure engagement inside the opening.

The formed part may, for instance, consist of a hard material with low deformability, particularly plastic. It is however better to use a material with elastic properties, so that it can engage in the opening.

In a different embodiment of this invention the formed part is pushed longitudinally into the box floor. If required the formed part may also work in conjunction with the box sides.

Furthermore it is envisaged that the means which holds the part of the rope loop which is to be anchored substantially at a right angle to the longitudinal elevation of the box is an integral flap of the box. Such a design would enable very easy manufacture of the box, whereby the return, which bears the bending forces, is already integrated into the device. This may for example be achieved by a suitable press operation. Similarly it is also feasible to weld or glue the flap to the box to achieve a single integral unit.

One preferred embodiment of this invention proposes that the box floor provides internal and/or external fixing means, which hold the formed part near the opening. In this instance, the only function of the formed part is to close the opening, which may for example serve as deflector, sufficiently that no concrete can flow through the remaining gap and between the opening and the rope loop protruding therefrom. The holding means in this case too is constructed simultaneously with the creation of the deflector or opening. This may be achieved during manufacture through the use of an appropriate press tool. One example of a holding means would be a clip, bent upwards from the box floor. Where the box is, for example, made from plastic, its design could be created by an appropriate injection moulding tool. As the formed part does not need to have to withstand undue forces in this role and in particularly not the bending stresses of the flexible rope loop, the holding means does not need a particularly robust means for connecting it to the box. It must only be ensured that the formed part covers the gap. The holding means may be oriented towards the finished concrete component either in the holding box or on its underside. A corresponding sealing means may be applied to either side and this may be attached using the holding means.

The retaining elements are preferably formed by rails oriented towards the inside along the edge of the limbs of the U. Such rails can, for example, be created by a bending process. Preferably such rails extend over the entire length of the box, which makes the box substantially stiffer, although only a limited retaining effect is required for the rope loop. Therefore, individual holding points inside the box are also an option.

The rails should offer a width of at least half the diameter of the wire rope of the rope loop. This ensures that the inserted rope loop is securely held. However, sufficient space remains between the rails in order to be able to place the rope loop into an upright position after the concrete component has been displaced.

It is advantageous if the box end is sealed.

The box is provided with end covers, which may, for example, be obtained through a bending operation. One such design is particularly suitable if the box is made from sheet steel. This enables the creation of a single unit design promising high rigidity and low manufacturing effort. It is also feasible to provide an end cover made from plastic, which is pushed onto the box end.

In certain cases it may be preferable to provide several openings in the box. Such a box would support several rope loops.

In order to securely anchor the box in the concrete component it is advisable to arrange suitable means on the floor and/or sides of the box, such as ribs, projections or indentations.

It is advisable that the box provides a removable cover on the shuttering side. This provides for only a small risk of ingress of concrete into the box during the concreting process. This cover, which may for example be a film, does not interfere with bringing the rope loop into an upright position. It may also be easily removed. Particularly the use of self-adhesive film or tape ensures optimal effect with minimum effort. By using double-sided adhesive film, the box may also be simply placed on smooth shuttering surfaces made, for example, from steel or plastic.

Figure 1:
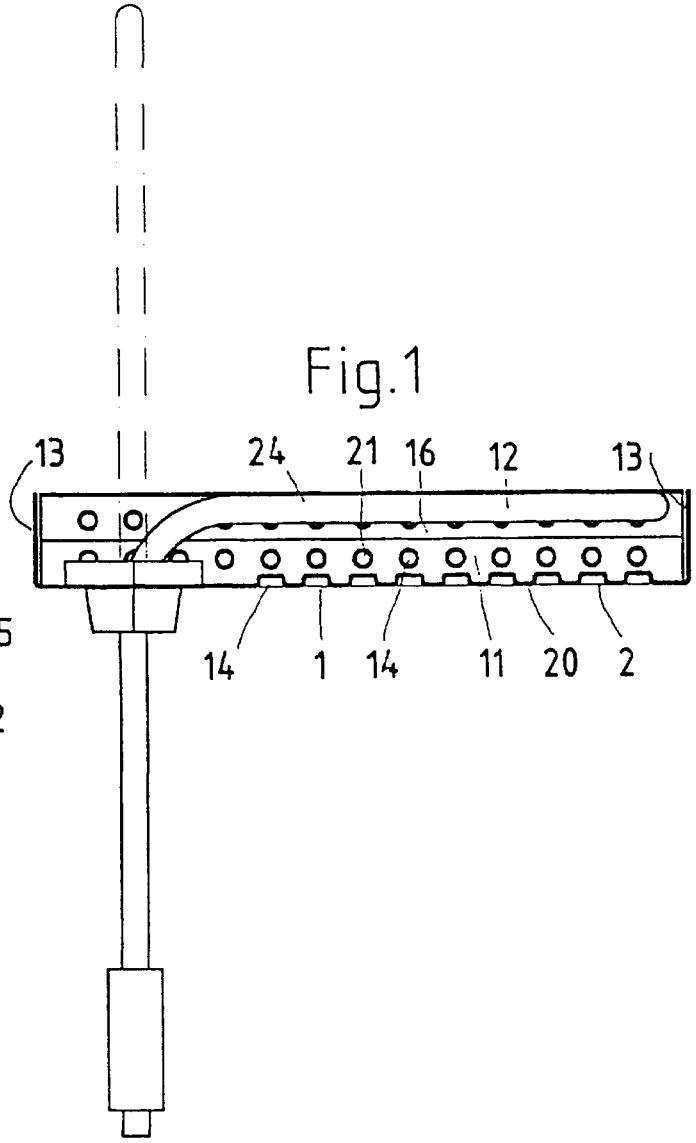
Figure 3:
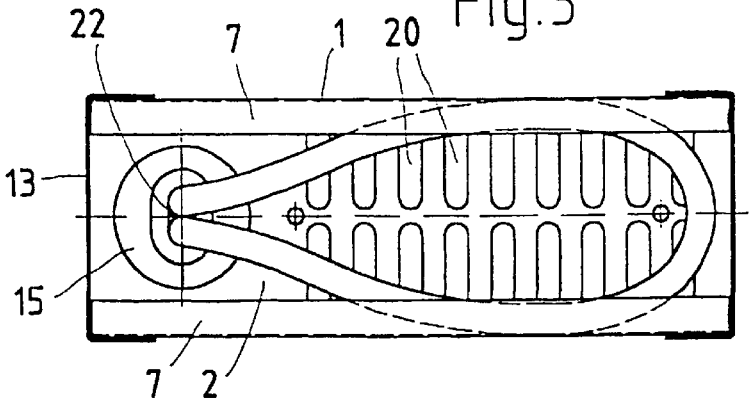
Figure 5:
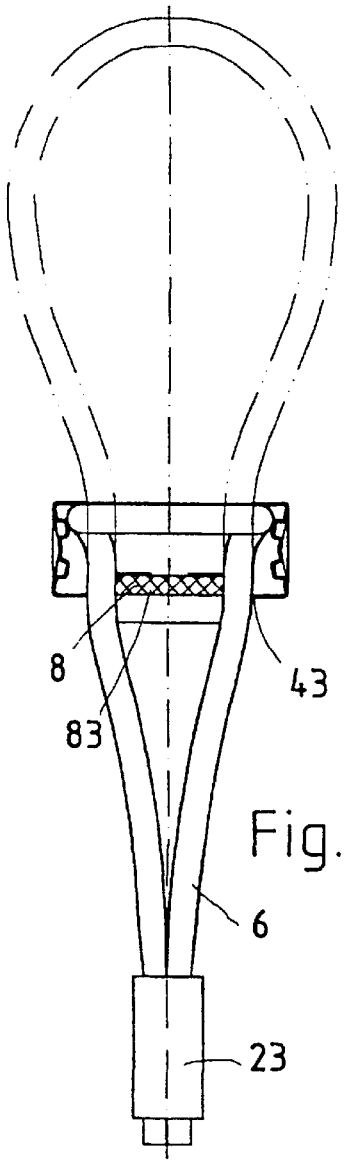
Figure 4:
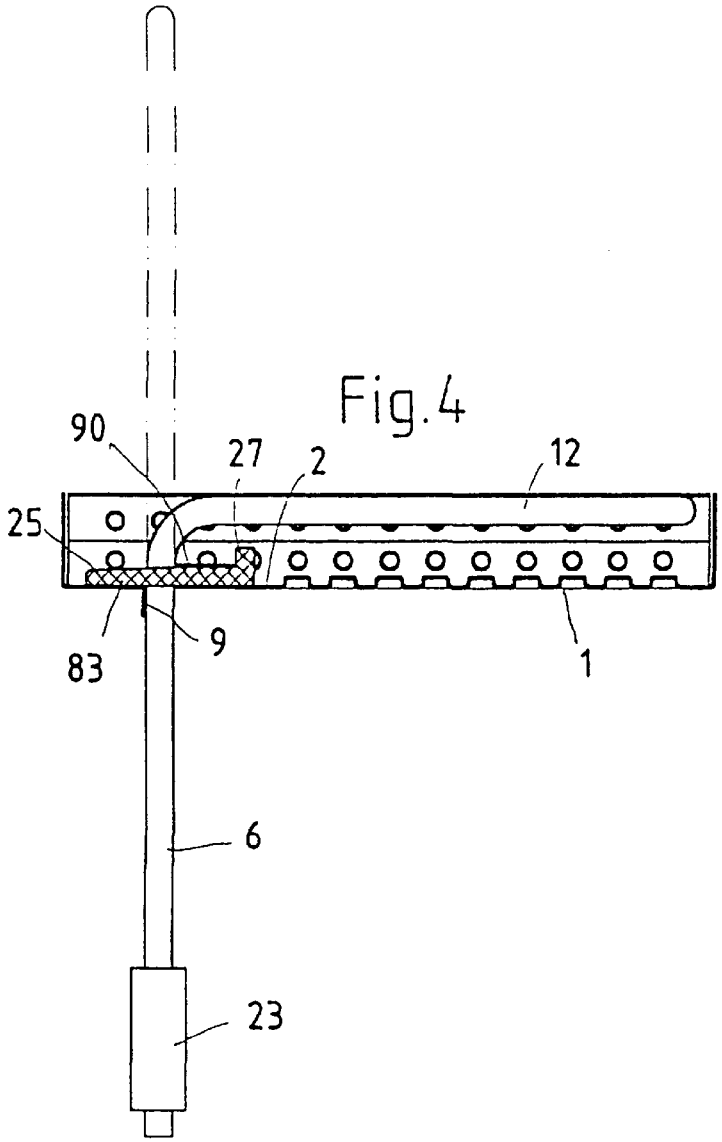
Figure 6:
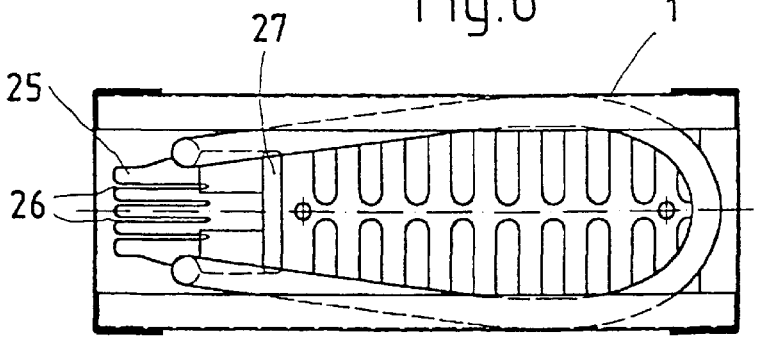
Figure 8:
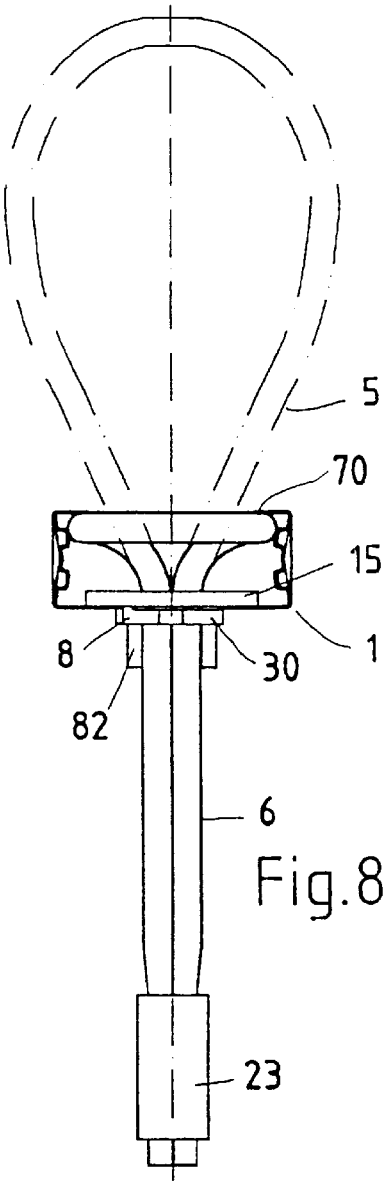
Figure 7:
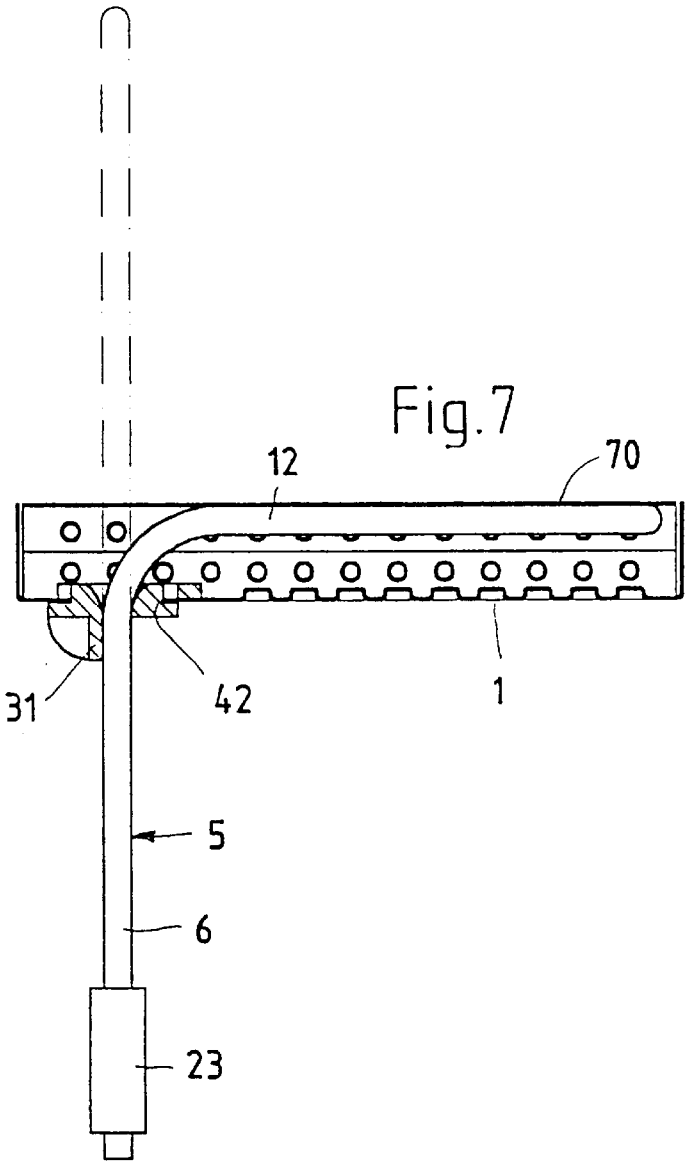
Figure 9:
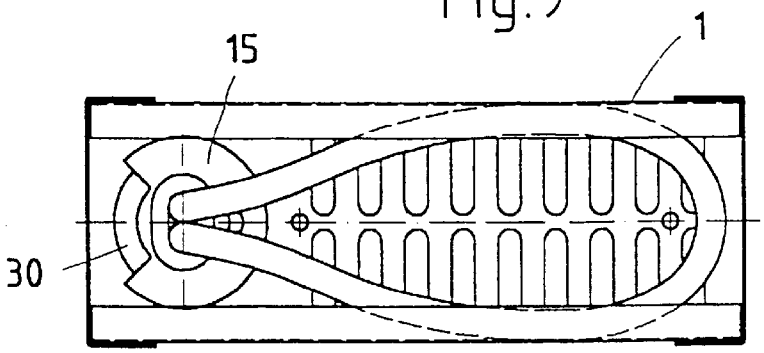

Several embodiments of this invention are shown, by way of example only, in the attached drawings, which show:

FIG. 1 a sectional elevation of the device according to this invention;

FIG. 2 a sectional projection through the illustration shown in FIG. 1;

FIG. 3 a top projection of the illustration shown in FIG. 1;

FIGS. 4, 5 & 6 illustrations of a further example of an embodiment of this invention and FIGS. 7, 8 & 9 illustrations of a further example of an embodiment of this invention.

The device for connecting, concrete components according to this invention is inserted in the peripheral region of a concrete component so that the surface 17 of box 1 is approximately level with the external surface 18 of the concrete component 19.

Box 1 shown in the drawings is made from sheet steel, such as galvanised steel. However, box 1 may also be made from plastic. The box floor 2 form s the bow of the U, whilst the sides 16 form the limbs 11. Floor and sides are provided with means 14 for improving the anchoring inside the concrete component 18, the floor being provided with ribs 20 and the sides with indentations 21.

The box floor 2 is provided with an opening 4, which in the examples shown is formed by a press operation. The opening may be circular. However, it may also be another shape.

In the example shown in FIGS. 1 to 3, a formed part 81 is inserted into opening 4, which may, for example, be made from plastic. The formed part 81 provides a recess 22, so that the formed part can be threaded onto the rope loop 5. This rope loop is formed by a piece of wire rope, whose ends are connected by a clamping sleeve 23, which is pressed onto the rope ends. After assembly, the clamping sleeve 23 is at least the same size as recess 22 in the formed part 81 and smaller than opening 4.

If the formed part 81 together with the rope loop 5 is set into the opening 4, the loop part 24 can be laid into the box 1. In its laid down position the loop part 24 is held by rail-shaped holding elements 7, which are formed by bending the upper edge 10 of the limbs 11. The width of rail 7 must be sufficiently large to securely hold the loop part. This is achieved, for example, if the rail width is equal to at least half the diameter of the wire rope.

However, individual holding elements may also be provided on the inside of the box, which hold the loop part back. The rope loop is flexibly shaped, whilst all forces are taken up by the box.

Sufficient space remains between the rails 7 to enable the loop part 7 to be removed and put into an upright position after being assembled. This is indicated by the broken lines in FIGS. 1 and 2.

The formed part 8 or 81 of the example shown in FIGS. 1 to 3 is made from elastic material. However, less elastic or rigid materials may also be used, if the dimensions are so chosen that the rope loop can be threaded. It is also possible to slide the formed part 8 or 81 onto the wire rope ends before the sleeve 23 is pressed onto the ropes, which would enable the gaps between the wire rope and the formed part 8 to be extremely small.

The formed part 8 should also ensure that the inside of box 1 is sealed.

Both ends of the box are provided with end covers 13, which are made by bending. Other closures, such as plastic plugs, which are fitted later, are also possible.

The rail-like retaining elements 7 also enable a pull-off cover to be fitted, such as, for example, film, which would contribute to the prevention of concrete ingress into the box. The film is then torn off prior to the loop being put into an upright position.

The example in FIGS. 4 to 6 differs from that in FIGS. 1 to 3 essentially in that the formed part 83 used here and the appropriate opening 43 each have a different shape. The formed part 83 is designed as a slider and comprises a tongue part 25 which, by virtue of cuts 26, becomes flexible. The formed part can be moved at rib 27. The formed part 83 is pushed between both rope strands of rope loop 5, which leads to the loop being held firmly. The opening is preferably designed as a slot, which enables loop part 24 to be inserted into the opening from underneath the box.

The opening is created by bending off a flap 9, which acts as support for the rope loop 5, so that the required position (see FIG. 4) results. In addition the box floor 2 comprises holding means 90, which serve to hold the formed part 83 in such a way at the opening, that the remaining gap between the rope loop 6 and the opening is closed. The holding means 90 and the flap 9 as well as the opening 4 are preferably created in one manufacturing step, for example, through a press operation. This results in a simple and cost effective creation of the invention. As FIG. 4 indicates, it is possible to arrange the holding means 90 in the holding box. However, it is equally feasible to arrange the holding means 90 underneath, oriented in the same direction as the flap 9 to be able to fix a corresponding formed part thereon.

In this case the formed part can, for example, be forked, to facilitate easy threading onto the rope loop. As shown, the formed part is inserted from the right side against opening 4 and is therefore positioned at the angle of the angled rope loop. It is also possible to insert formed parts with openings for the rope ends and/or the formed part from the left, against the rope loop.

In the embodiment shown in FIGS. 7 to 9, the formed part 82 and the opening 42 are designed so that the formed part 82 may be inserted together with the rope loop 5 in a set position, which in its assembled state is turned approx. 90° to the final position shown in the drawing. For this purpose the formed part 82 and the opening 42 deviate from the rotational symmetry, which is clearly shown in FIG. 9.

The flange 15 is large enough and supplemented by a further flange 30 on the other side of the box floor, so that the opening is securely closed after a rotational movement.

Furthermore the formed part 82 has an extension 31, which holds the part of the rope loop 6 which is to be concreted in its required position. The positioning forces for the flexible forming of the rope loop are absorbed by the sheet steel component. In addition, a removable cover 70 is provided outside of the box 1. The removable cover is a double-sided adhesive tape to fix the box on the shuttering.

This invention relates not only to the device described above but also a process for the manufacture of such devices. The process introduced here represents a cost effective means for the production of the device described above. Furthermore, a concrete component is also described, which is equipped with a respective device and which, through the inventive design, enables easier processing.

The descriptions presented now and the claims to be presented later are attempted formulations without prejudice to the obtaining of broader protection.

References in the sub-claims relate to further designs of the subject matter of the main claim through the features of the respective sub-claim. These are, however, not to be understood as waiver of independent protection for the features of the sub-claims.

Characteristics only disclosed in the description may, in the course of proceedings, be claimed as being of inventive relevance, i.e. for example to distinguish from the state of the art.

What is claimed is:

1. Device for connecting concrete components, comprising at least one rope loop, anchored at one end directly in the concrete component, and whose other looped end works in conjunction with a fixing device set into the face of the concrete components, in order to flexibly bend the rope loop during manufacture of the concrete component approximately into a right angle position and to release the loop to permit connection, the fixing device being designed as an elongated U-shaped box with an essentially uniform cross section, a floor of the box being provided with one or more openings for the rope loop with means near the opening which holds the part of the rope loop to be anchored essentially at a right angle to a longitudinal plane of the box, and retaining element arranged in an edge region of legs of the U, which hold the bent-over rope loop inside the box in a holding position, yet which enable the rope loop to be disengaged from the holding position.

2. Device according to claim 1, wherein a flap at the opening acting on the part of the rope loop which is to be anchored, which flexibly shapes the loop in conjunction with the box and the retaining elements.

3. Device according to claim 1, wherein a seal closes a gap formed between the rope loop and the opening.

4. Device according to claim 3, wherein a formed part is provided as the seal.

5. Device according to claim 1, wherein a formed part set into the opening acts on the part of the rope loop which is to be anchored and flexibly shapes the rope loop in conjunction with the box and the retaining elements.

6. Device according to claim 1, wherein the formed part is provided with a flange, which abuts the box floor.

7. Device according to claim 4, wherein the formed part and the opening are at a variance from rotational symmetry, in order to fix and seal the inserted formed part by a rotational movement inside the opening.

8. Device according to claim 1, wherein an elastic formed part is engaged in the opening.

9. Device according to claim 8, wherein the formed part is inserted parallel to the longitudinal plane of the box floor.

10. Device according to claim 1, wherein the means holding the rope loop part which is to be anchored substantially at a right angle to the longitudinal plane of the box is formed as a flap which is an integral part of the box.

11. Device according to claim 3, wherein the box floor includes a holding means, which holds the formed part near the opening.

12. Device according to claim 1, wherein at the edge region of the legs of the U-shaped box, rails are provided which are oriented towards the inside and which act as the retaining elements, and which have been created through bending.

13. Device according to claim 12, wherein a width of the rails is at least equal to half a diameter of the wire rope of the rope loop.

14. Device according to claim 1, wherein ends of the box are sealed off.

15. Device according to claim 1, wherein the box is provided with several openings.

16. Device according to claim 1, wherein the box is provided with means on the floor for anchoring the box in the concrete component.

17. Device according to claim 1, wherein a removable cover is provided at an out side of the box.

18. Device according to claim 17, wherein the removable cover is a double-sided adhesive means.

19. Process for the manufacture of a device according to claim 1, wherein the opening and the means for holding as well as the provision of a flap are created in one manufacturing step, through a press operation.

20. Concrete component with a device according to claim 1.

21. Device according to claim 1, wherein the box is provided with means on the sides for anchoring the box in the concrete component.

22. Device for connecting concrete components, comprising at least one rope loop, anchored at one end directly in the concrete component, and whose other looped end works in conjunction with a fixing device set into the face of the concrete component, in order to flexibly bend the rope loop during manufacture of the concrete component approximately into a right angle position and to release the loop to permit connection, the fixing device being designed as an elongated U-shaped box with an essentially uniform cross section, a floor of the box being provided with one or more openings for the rope loop with retaining means formed in the opening by bending or punching which holds the part of the rope loop to be anchored essentially at a right angle to a longitudinal plane of the box, and retaining element arranged in an edge region of legs of the U, which hold the bent-over rope loop inside the box in a holding position, yet which enable the rope loop to be disengaged from the holding position.

* * * * *